United States Patent [19]

Le et al.

[11] Patent Number: 4,519,262

[45] Date of Patent: May 28, 1985

[54] POSITIVE ENGAGEMENT SAFETY MECHANISM AND LIFT BELT CONSTRUCTION FOR LONG STROKE, WELL PUMPING UNIT

[75] Inventors: Tam D. Le; Weems D. Turner, both of Houston, Tex.

[73] Assignee: Baker Oil Tools, Inc., Houston, Tex.

[21] Appl. No.: 489,728

[22] Filed: Apr. 29, 1983

[51] Int. Cl.[3] ..... B66B 5/26

[52] U.S. Cl. ..... 74/89.2; 187/77; 192/8 A

[58] Field of Search ..... 74/89.2, 89.22; 187/77, 187/82, 81; 188/272, 391; 192/8 A

[56] References Cited

U.S. PATENT DOCUMENTS

| | | | |
|---|---|---|---|
| 360,504 | 4/1887 | Albert | 187/77 |
| 435,232 | 8/1890 | Lynn | 187/82 |
| 713,705 | 11/1902 | Smith | 187/77 |
| 720,332 | 2/1903 | Day | 187/82 |
| 855,646 | 6/1907 | Lehn | 187/82 |
| 931,211 | 8/1909 | Moulton | 187/82 |
| 1,002,048 | 8/1911 | Faulkner | 187/77 |
| 1,013,232 | 1/1912 | Stine | 187/82 |
| 1,166,500 | 1/1916 | Wasden | 187/82 |
| 1,302,059 | 4/1919 | Linn | 187/82 |
| 1,482,331 | 1/1924 | Vanslett | 187/82 |
| 3,248,958 | 5/1966 | Bender | 74/89.2 |
| 3,483,828 | 12/1969 | Bender | 103/206 |
| 4,388,837 | 6/1983 | Bender | 74/89.2 |

*Primary Examiner*—Allan D. Herrmann

*Attorney, Agent, or Firm*—Edward L. Jensen

[57] ABSTRACT

A self-energizing, positive engagement safety mechanism for long stroke, well pumping units, whether powered mechanically or hydraulically, and which employ a lift belt and counterweight. Upon failure of the sucker rod, polish rod or lift belt, a latching mechanism is actuated to engage a rack on both sides of the counterweight thereby to arrest and lock the counterweight against free fall. Actuation of the latching means is controlled by sensing belt tension below the counterweight thereby to enhance the sensitivity and reliability of the safety mechanism.

7 Claims, 6 Drawing Figures

Fig. 2
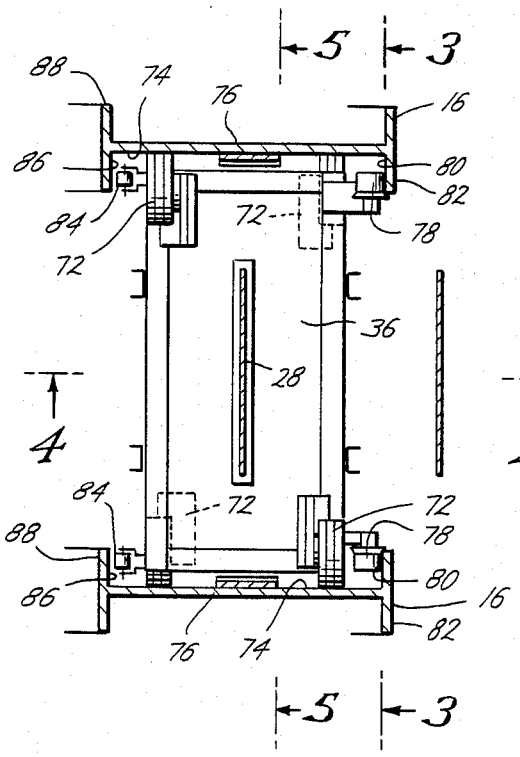
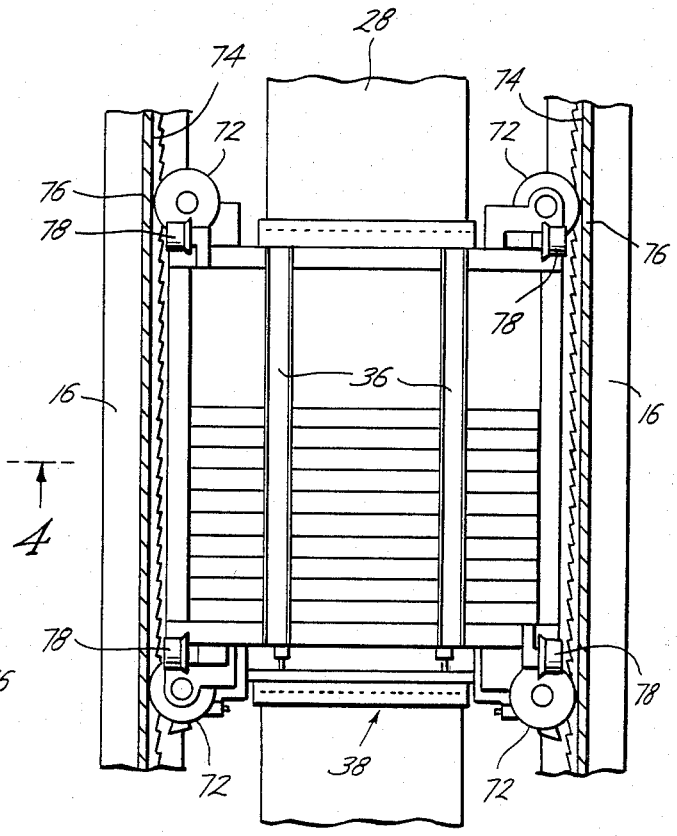
Fig. 3
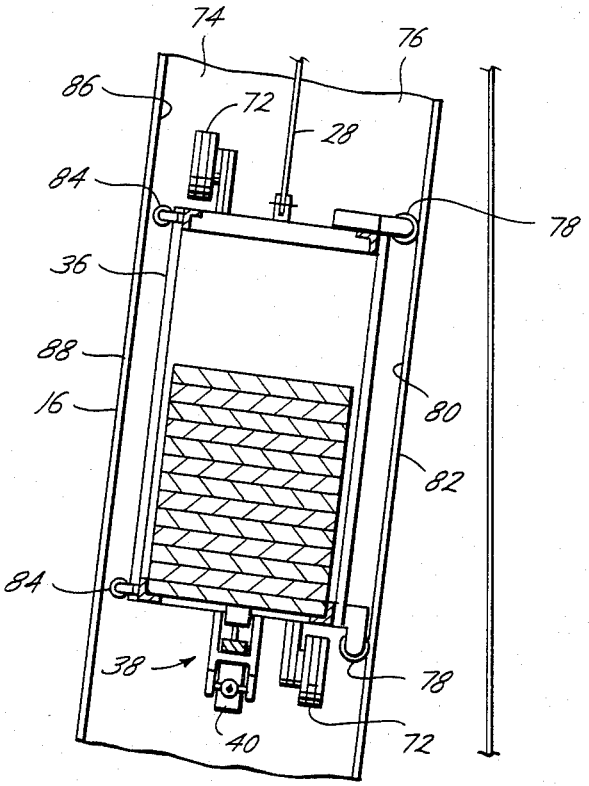
Fig. 4

POSITIVE ENGAGEMENT SAFETY MECHANISM AND LIFT BELT CONSTRUCTION FOR LONG STROKE, WELL PUMPING UNIT

BACKGROUND OF THE INVENTION

This invention relates generally to well pumping units and more particularly to an improved safety mechanism for shutting down operation of the pumping unit in the event of failure of one or more components on the lift side of the pumping unit, when under load. Such failures, although rare, have disastrous consequences both for personnel in the area and the equipment being used.

The present invention has utility with a wide variety of well pumping units. One such well pumping unit includes a tower or mast mounted on a base platform, a source of power and a winding drum on the base platform, a lift belt made of conveyor belting from the winding drum up the tower and over a crown spool mounted atop the tower and then extended downwardly and connected to the polish rod of a well pump, and a reversing mechanism associated with the power means reciprocate the belt and thus the polish rod, and thereby to operate the pump. A counterweight or weight box is interposed in that portion of the drive belt between the spool and the winding drum so that power requirements of the pumping unit are kept to a minimum. An idler spool is provided at the base of the tower and that portion of the lift belt between the counterweight and the winding drum is trained beneath the idler spool so as to restrict movement of the counterweight to a generally vertical direction within the tower during operation of the pump.

The need for a safety mechanism is particularly acute during a lifting stroke of the pumping unit. The polish rod load may well be in the area of, for example, 30,000 pounds and the counterweight will be weighted only somewhat less than the polish rod load. If that portion of the lift belt between the spool on the top platform and the polish rod should fail or if one or more of the polish rod, rod string and sucker rod components of the well pump should fail, the counterweight will fall to the base platform and the lift belt will unravel from the spool; the possible, disastrous consequences are self-evident. Accordingly, this invention provides a mechanism for immediately arresting and locking the counterweight in place in the event of a failure as just described.

A brief description of the development of well pumping units is in order. In the early life of a well, reservoir pressure alone may be sufficient to raise the oil to the surface, providing local regulatory authorities permit such a procedure. However, such pressure is eventually exhausted and the oil must be pumped to the surface to be recovered. The most common variety of pump employed for this purpose is a walking beam pump having a nominal stroke distance of from about seven to twelve feet. A walking beam pump is suitable for shallow to medium depth wells, but such a pump becomes inefficient as stroke frequency increases. Specifically, rod stretch, dynamics and pump volumetric efficiency combine to decrease efficiency as stroke frequency increases.

Thus, long stroke well pumping units, particularly useful in deep wells, have been developed, some of which have stroke lengths of thirty-two feet or more. One example of such a prior art long stroke pumping unit is the "Oilwell" Model 3534 Long Stroke Pumping Unit, manufactured by Oilwell, a division of United States Steel. The unit includes a central tower having multiple braces to stabilize the structure, a complex multi-strand cable crown block assembly suspending the rod string and a variable capacity counterweight and, of course, a prime mover. Several safety systems are provided, including an automatic air brake system controlled by an overspeed governor flyweight and actuated when the counterweight exceeds a predetermined, acceptable downward speed. Other safety features include interlocked controls and automatic breaking in the event of an air loss or power failure. Both the pumping unit and the safety features provided are complicated and quite expensive.

Another example is prior U.S. Pat. No. 3,248,958 issued to Emil A. Bender, which discloses and claims a wire line deep well pumping apparatus and a safety brake system which includes a somewhat complex system for jamming a cam against the wire lines in sheaves mounted atop a tower in the event of rod string failure, thus preventing the counterweight from falling. Another prior U.S. Pat. No. 3,483,828 issued to Emil A. Bender, also discloses a deep well pumping unit, and describes generally a braking system which is actuated in the event of failure. A more recent example in a long stroke pumping unit is yet another invention of Emil A. Bender which is the subject of a co-pending application Ser. No. 393,102, filed June 28, 1982, and licensed to the Assignee of the present invention, Baker Pro-Lift, Inc. The fail safe mechanism described in that application is arranged in a lift belt system and includes a wedge and brake shoe combination mounted on the top of the tower which is actuated to grasp the lift belt in the event of fracture of the belt, polish rod, rod string or sucker rod on the polish rod side of the crown spool.

However, the prior art does not disclose a safety mechanism for well pumping units of the type described herein which provides sensitivity and consistent reliability over the wide range of load fluctuations that may be experienced within even a single cycle of the pumping unit. The load on the polish rod side of a lift belt system varies in a representative installation from a maximum of approximately 29,700 pounds, when the polish rod is at its lowermost position and beginning an upstroke and thus experiencing the full fluid and dynamic load, to a minimum of 18,100 pounds, when the polish rod is at its uppermost position and beginning to fall back down through the fluid. The counterweight or weight box in this example is loaded with 16,300 pounds or approximately 90% of the minimum load on the polish rod side, to reduce power requirements of the system to a minimum and yet provide sufficient weight differential to allow the polish rod and rod string to fall gently through fluid to its lowermost position again. The prior art safety mechanisms all sense off of the polish rod side of the system and therefore must withstand the maximum load to minimum load fluctuations which requires a heavy duty safety mechanism and an attendant sacrifice of sensitivity. Attempts to increase sensitivity in such prior art examples results in frequent malfunction wherein the brake or safety mechanism prematurely locks up and disrupts the operation of the pumping unit although no failure or fracture in the lift belt system has occurred.

Reference to other arts where a similar problem is experienced leads inevitably to the elevator art and in particular to prior emergency brake systems developed therein to avert human tragedy in the event of cable separation. It was recognized in the very early stages of this art that a rack and pawl combination was the most dependable safety latch and the risk to human life demanded a heavy duty arrangement. Representative examples of such prior art safety devices include U.S. Pat. No. 931,211, issued to E. E. Moulton, wherein a cross bar at the top of an elevator cage is secured to the cable and counter-biased by a coiled spring against cable tension. Tension in the cable overcomes the counter-bias and the cross bar engages and pivots a pawl arranged at either side of the elevator cage out of engagement with corresponding racks mounted in alignment therewith in the elevator shaft. The pawls are spring-biased toward a position in engagement with the rack, however, so that upon cable failure and the attendant release of tension therein, the counter-bias of the coiled spring forces the cross bar out of engagement with the pawls and allows the pawls to spring into engagement with the corresponding racks to arrest free fall of the elevator cage. A variation of this concept may be seen in U.S. Pat. No. 1,482,331, issued to J. Vanslett, wherein the pawls are spring-biased out of engagement with the corresponding racks, and the counter-bias force (provided in this case by a pair of opposing leaf springs) drives a wedge arranged between the pawls to engage the pawls with the corresponding racks in the event of cable failure. In another such example, disclosed in U.S. Pat. No. 1,302,059, issued to J. A. Linn, the safety devise is mounted beneath the elevator cage and connected to the cable above the cage through an inverted U-shaped yoke arranged to pull a pair of pawls in scissors fashion out of engagement with corresponding rack when the cable is in tension, and counter-bias springs force the pawls again in scissors fashion into engagement with the racks upon cable failure.

One obvious distinction in the foregoing and similar examples of prior safety mechanisms in the elevator art lies in the fact that the lift cable or cables are exclusively tensioned above the elevator cage; thus, each of the various safety mechanisms conceived to respond to cable failure must of necessity have an operative link to the cable above the cage for actuation. Another significant distinction between such examples and the lift belt, well pumping units previously described is that the maximum load and load fluctuations experienced in normal duty is significantly less. Therefore, the responsiveness and sensitivity are not compromised by the mass of the system or extreme load differentials and the attendant sizing difficulties for actuating mechanisms such as the springs described. The foregoing distinctions are best put in perspective by considering the complexity and near impossibility of sizing actuating mechanisms such as the springs described for heavy duty service wherein loads approaching 30,000 pounds and load fluctuation of 12,000 pounds, or more, are experienced under normal operating conditions, which actuating mechanisms must be sensitive to load failure and yet avoid premature actuation due to normal load fluctuations.

Accordingly, the prior art does not disclose a safety mechanism for well pumping units and the like which provides sensitivity and consistent reliability over a wide range of severe loads and load fluctuations without premature actuation, and which is of uncomplicated structure and requires no power means in order to be operated. Additionally, the prior art does not disclose the safety mechanism herein disclosed and claimed in a lift belt system for transmitting reciprocating motion to the polish rod in a long stroke, well pumping unit.

SUMMARY OF THE INVENTION

Therefore, it is a principal object of this invention to provide a safety mechanism for a well pumping unit or the like which is completely mechanical in structure and operation and thus has no power requirements and which is operable to immediatley shut down operation of the pumping unit in the event of failure of one or more of the components of the pumping unit.

It is another object of the invention to provide a safety mechanism for a well pumping unit which includes a base platform, tower and top platform upon which a spool is mounted, a lift belt being trained thereover and connected at its ends to the polish rod and winding drum of the pump, the lift belt being the connective component for imparting reciprocation to the polish rod and rod string of the pump, the lift belt being provided with a counterweight between the spool and winding drum and the safety mechanism being located beneath the counterweight and operable upon failure of one or more of the rod string components to arrest and lock the counterweight against falling.

It is yet another object of the invention to provide a safety mechanism in a lift belt system for long stroke, well pumping units such as that described, wherein the safety mechanism is beneath the counterweight and senses off the lift belt below the counterweight and thus is subjected only to the load differential between counterweight and the polish rod load at any given point in a cycle of the pumping unit.

It is still another object of the invention to provide a safety mechanism in such a long stroke, well pumping unit, which safety mechanism is sensitive to load failure and provides positive responsiveness, yet is not prematurely actuated by widely disparate load fluctuations experienced under normal operating conditions.

Generally speaking, the long stroke, well pumping unit with which the invention may be used includes a base platform, a tower or mast on the platform, and a rotatable winding drum located on the platform with a mechanical or hydraulic drive to impart rotation to the winding drum. A flexible lift belt is attached at one end to the winding drum and at its other end to the upper end of the polish rod of a well pump. A freely rotatable spool is located atop the tower and the lift belt is trained over the rotatable spool. A counterweight or weight box is interposed in the lift belt between the winding drum and the spool. A reversing mechanism is associated with the hydraulic or mechanical drive for the winding drum to thereby provide reciprocating movement through the lift belt to the polish rod. The self-energizing, positive engagement safety mechanism of the invention, which terminates operation of the pumping unit in the event of failure by fracture of the lift belt, polish rod, rod string or sucker rod, includes a cross bar securely fastened to the upper end of the lift belt beneath the counterweight, a guide member dependent from the counterweight and arranged to receive the cross bar and permit only limited movement thereof longitudinally in the plane of the belt, mechanism arranged on the guide member for exerting a predetermined counter force on the cross bar in opposition to tension on the lift belt, a pair of racks mounted within the tower one on either side and in the plane of the belt, a latch mechanism located on the guide member adjacent to each of the racks in opposing relationships for movement into and out of engagement therewith, mechanism arranged on the guide member and responsive to movement of the cross bar longitudinally in the plane of the lift belt to move the latch means out of engagement with said racks when tension on the lift belt overcomes the predetermined counter force and for moving the latch means into engagement with the racks when tension on the lift belt is reduced below the level of the predetermined counter force. The predetermined counter force is selected so as to permit disengagement of the latch mechanism from the racks under belt tension corresponding to the normal operating loads of the pumping unit whereupon failure by fracture as described reduces tension below the level of the counter force on that portion of the lift belt beneath the counterweight thereby to allow the cross bar counter force exerting mechanism to displace the cross bar longitudinally in the plane of the lift belt and cause the latch engagement mechanism to move the latch means into engagement with the racks, thereby to arrest and lock the counterweight against free fall.

Further novel features and other objects of this invention will become apparent from the following detailed description, discussion and the appended claims taken in conjunction with the accompanying drawings.

BRIEF DESCRIPTION OF THE DRAWINGS

A preferred structural embodiment of this invention is disclosed in the accompanying drawings in which:

FIG. 2 is a fragmentary plan view taken along line 2—2 in FIG. 1 depicting details of the weight box guidance system;

FIG. 3 is a fragmentary front elevation view taken along line 3—3 in FIG. 2 exposing other details of the weight box and guidance system;

FIG. 4 is a fragmentary side elevation view taken along line 4—4 in FIG. 2 showing the weight box and guidance system from yet another angle.

DESCRIPTION OF THE PREFERRED EMBODIMENT

Figure 1:
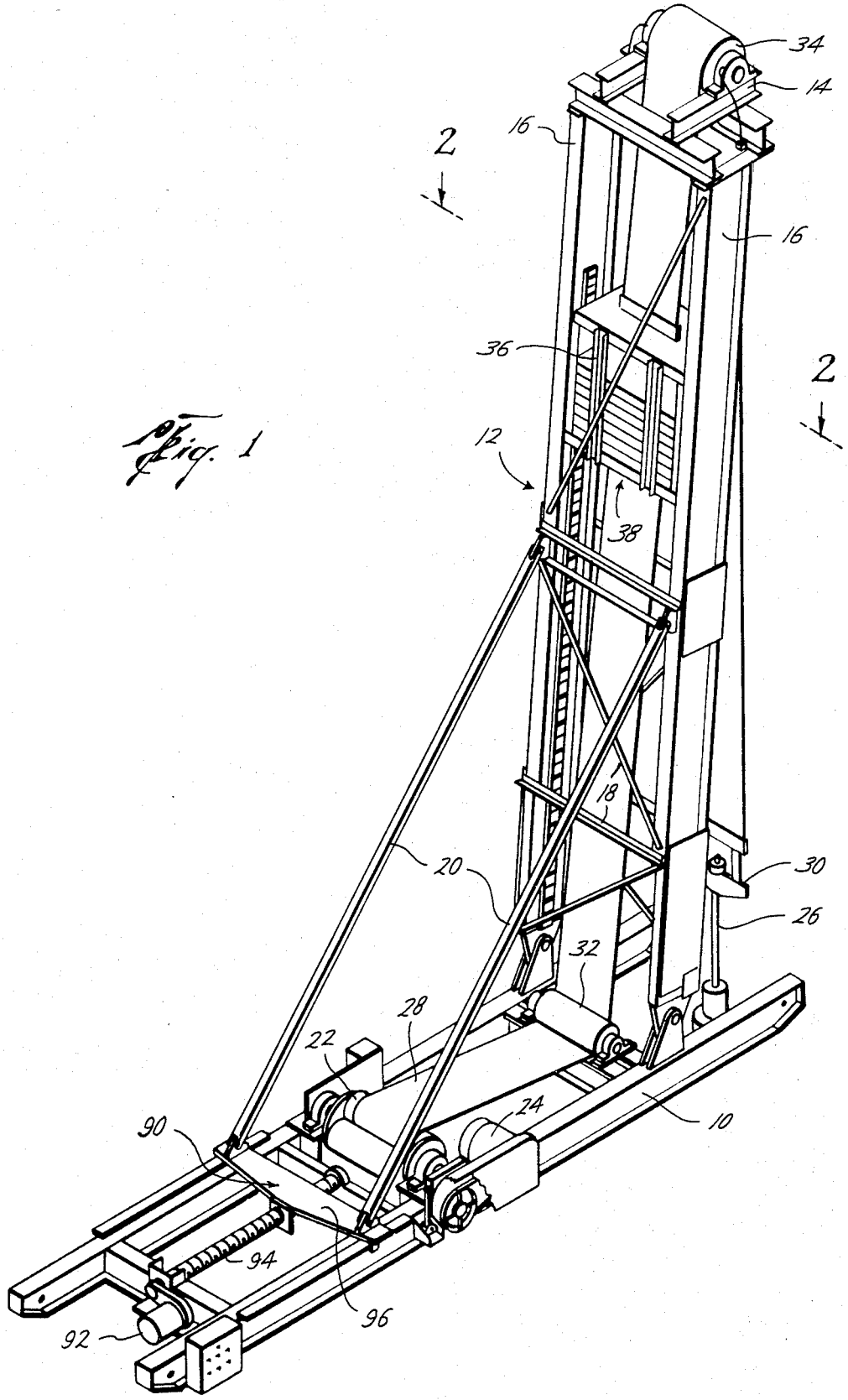
FIG. 1 is an isometric elevation view of a well pumping unit of this invention.

Referring now to the drawings by reference character, and in particular to FIG. 1 thereof, an improved, long stroke well pumping unit is illustrated. A skid mounted base platform 10 supports a tower structure or mast 12 and a top platform 14 surmounts the mast 12. The mast 12 is composed of two parallel I-beams 16—16, pivotally mounted to the base platform 10 and structurally stabilized intermediate their lengths by a series of cross members and struts 18—18, the beams 16—16 being further stabilized vertically with respect to the base platform 10 by two parallel mast supports 20—20. A rotatable winding drum 22 is located on base platform 10 and is driven from a suitable power source 24 which may be mechanically or hydraulically driven and is also located on base platform 10. A reversing mechanism (not shown) is also provided in association with the power source for periodically reversing rotation of the winding drum in a manner described in greater detail hereinbelow. An otherwise conventional well pump (not shown) includes a rod string and sucker rod therein, topped by a conventional polish rod 26. A flexible lift belt 28 is secured at one end to rotatable winding drum 22 and at the other end to a yoke assembly 30 from which polish rod 26 is centrally suspended. Flexible lift belt 28 is reaved beneath an idler pulley 32 on base platform 10, then upwardly through mast 12 to and over a crown spool 34, freely rotatably mounted atop the top platform 14 and then vertically downwardly to yoke assembly 30. A counterweight or weight box 36 is interposed in lift belt 28 and reciprocates generally vertically, with movement of lift belt, between the upper and lower ends of the mast 12. During operation of the pumping unit, the reversing mechanism (not shown) allows belt 28 to be wound upon and unwound from winding drum 22 thus to impart reciprocating movement to polish rod 26 and the well pump.

As mentioned above, commercially available conveyor belting may be employed as the material for lift belt 28. One available brand of conveyor that might be used is that sold under the trademark "Unilok" as "PolyVinylok" conveyor belting. One particular material found to be useful is Unilok's PVK-350 material, a belting that is 10/32 inches thick, 15 inches wide and has an ultimate tensile strength at rupture of 3500 pounds per inch. Similar belting materials sold under the Unilok mark are available up to 15/32 inches thick and having an ultimate tensile strength at rupture of up to 9000 pounds per inch. Belt widths may vary from fifteen inches to twenty-four or more inches. The particular belting material chosen will depend on the requirements of the particular well pumping unit.

One particular embodiment of the well pumping unit under discussion is dimensioned to provide a twenty-five foot stroke in polish rod 26. Currently, a unit with a twenty-five foot stroke is most economically practical because commonly available, off-the-shelf components may be interfaced with the unit. Specifically, a standard long stroke pump is thirty feet long and has a plunger five feet in length. Standard polish rods and standard sucker rods making up the rod string of the pump are made in lengths which match the size demands of a twenty-five foot stroke pump unit. A comparison of the production figures of a standard walking beam unit with the long stroke pumping unit of this invention yields the following interesting results. In pumping a well about two mile deep, a standard walking beam unit with a ten-foot stroke and operating at eight strokes per minute will produce a net lift per minute of forty feet, when a rod stretch of five feet on the lift stroke is taken into account. On the other hand, use of a pumping unit as above disclosed with a twenty-five foot stroke and operating only at four strokes per minute yields a net lift per minute of eighty feet, again taking the five feet of rod stretch on the lift stroke into account. Thus, the present unit produces twice as much effective lift per minute than a standard walking beam unit. Equally importantly, the long, half speed stroke reduces the number of cycles required per minute, and extends rod life by reducing the number of stress cycles and extends tubing life by distributing wear over a greater area.

Figure 5A:
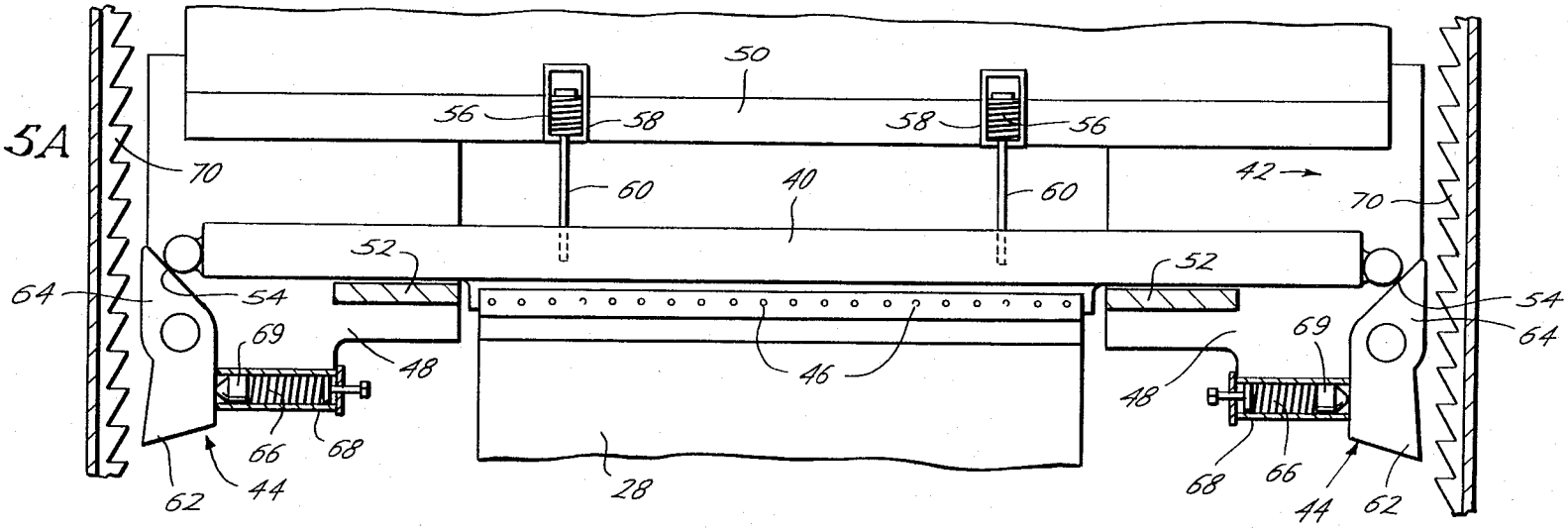
FIGS. 5A and 5B are fragmentary elevation views taken along line 5—5 in FIG. 2 depicting the safety mechanism of the invention in an unactuated and actuated condition, respectively.
Figure 5B:
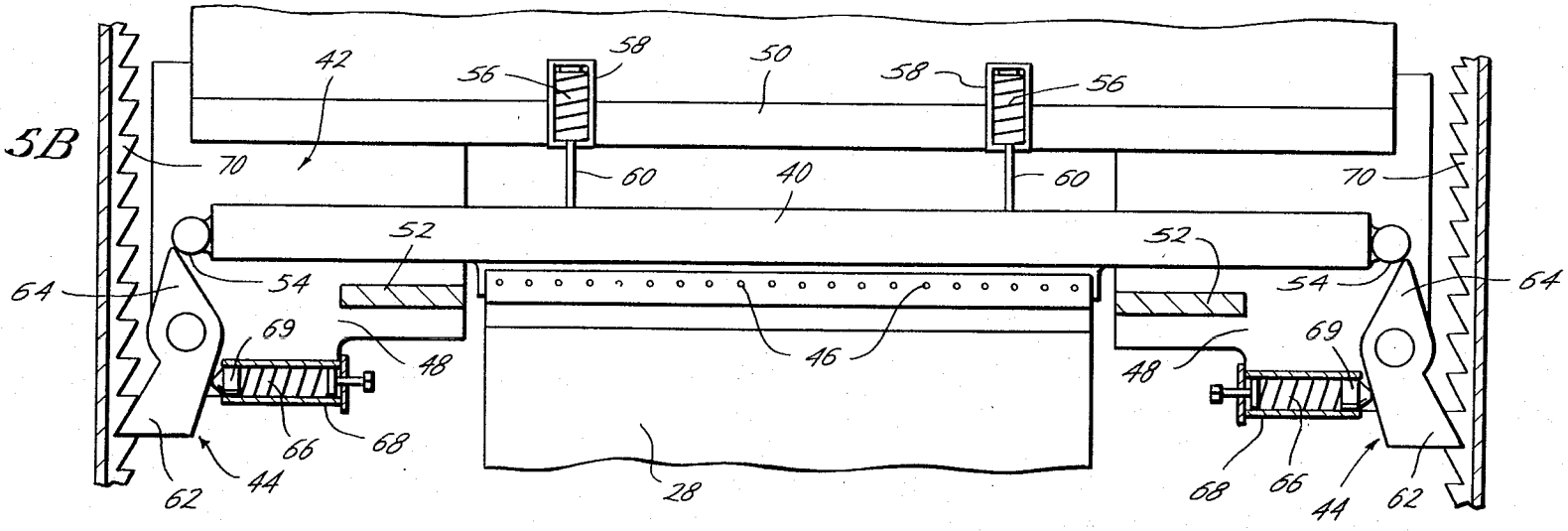

The safety mechanism of the present invention is located beneath the weight box 36 and is generally indicated by reference numeral 38. Referring now to FIGS. 3 and 5A and 5B, the components of the safety mechanism 38 include a cross bar 40, a guide member 42 dependent from weight box 36, and a rack and pawl arrangement indicated generally by the numeral 44 at either side of the weight box. The cross bar 40 is secured by conventional fasteners 46—46 to the upper end of lift belt 28 beneath weight box 36, and is received within guide member 42 between parallel plates 48—48 separated at their upper edges by a spacer plate 50 and provide with stops 52—52 to permit only limited movement of the cross bar longitudinally in the plane of the belt. The cross bar 40 is provided with camming surfaces 54—54 at either end and is biased by compression springs 56—56 secured at their lower ends in receptacles 58—58 in spacer plate 50 and connected at their upper ends to the cross bar as by spindles 60—60 passing axially back through the springs and secured to the cross bar. Springs 56—56 exert a predetermined counter force in opposition to tension on lift belt 28 and are sized so that belt tension under normal load conditions compresses springs 56—56 and forces the cross bar 40 against stops 52—52. A pair of pawls 62—62 are pivotally suspended between plates 48—48 on either side of cross bar 40 and are provided with lugs 64—64 arranged adjacent the camming surfaces 54—54 of the cross bar 40. A pair of compression springs 66—66 secured in receptacles 68—68 to resist compression, are arranged to bias pawls 62—62 through plungers 69—69 normally into engagement with a pair of racks 70—70 mounted in opposing relationship therewith. Each rack 70 is mounted on the interior web of one of the I-beams 16—16 in alignment with a corresponding pawl 62 and spans the entire length of travel of weight box 36 during a full cycle of the pumping unit.

As may be viewed in FIG. 5A, the safety mechanism 38 is responsive to tension on the lower portion of lift belt 38 which under normal operating loads overcome the predetermined counter force and compresses the springs 56—56 thereby forcing cross bar 40 against stops 52—52. Thus camming surfaces 54—54 are driven against lugs 64—64 to pivot pawls 62—62 out of engagement with the corresponding racks 70—70 and the weight box 36 is free to travel in the mast 12. Failure of the system by fracture of the lift belt, polish rod, rod string or sucker rod, reduces tension on the lift belt below the level of the predetermined counter force and allows springs 56—56 to expand, as shown in FIG. 5B, thereby raising cross bar 40 and causing camming surfaces 54—54 to recede and allow springs 66—66 to force plungers 69—69 to drive pawls into 62—62 into locking engagement with racks 70—70 and thus arrest and latch the weight box against free fall.

In a preferred embodiment, the weight box 36 is guided in its travel within the mast 12 to facilitate alignment between the pawls 62—62 and corresponding racks 70—70. As may be seen in FIGS. 2, 3 and 4, two side wheels 72—72 are rotatably mounted one on each side of weight box 36 in diagonally offset relationship, as for example, one side wheel 72 at the top front edge and the other side wheel 72 at the bottom rear edge on one side of the weight box and one side wheel 72 at the top rear edge and the other side wheel at the bottom front edge of the other side. The side wheels 72—72 engage and are guided by interior surface 74 of web 76 of the corresponding I-beam 16. In addition, front rollers 78—78 are rotatably mounted at each of the four corners on the front of weight box 36 to engage and ride on the interior surfaces 80—80 of front flanges 82—82 of the I-beams 16—16, and rear rollers 84—84 are rotatably mounted at each of the four corners at the rear of the weight box and arranged to ride on the interior surfaces 86—86 of rear flanges 88—88 of the I-beams. As may be seen in FIG. 1, the mast 12 is normally tilted forward at an angle of approximately 96 degrees under ordinary operating conditions, with the result that front rollers 78—78 carry the weight box load and ride front flanges 82—82, while rear rollers 84—84 are thereby held out of contact with rear flanges 88—88. However, if the mast 12 is tilted back to an angle of less than 90 degrees, to permit workover of the well for example, the weight box load is shifted to the rear rollers 84—84 and which ride rear flanges 88—88. Also in this preferred embodiment, a tilt mechanism is provided, indicated generally by the numeral 90 in FIG. 1, for adjusting the attitude of the mast 12 as aforesaid. Such a mechanism may include a drive motor 92, screw jack 94 and carriage 96 which cooperate to tilt the mast forward and back through mast supports 20—20. This tilt mechanism, though not essential to the present invention, is described in detail and claimed in a co-pending application Ser. No. 489,821 filed by the present inventors simultaneously herewith and assigned Baker Pro-Lift, Co.

As may now be more fully appreciated, the safety mechanism of the present invention senses off the lift belt below the weight box or counterweight, and thus sees only the tension resulting from the differential in load between the polish rod side of the mast and the weight box. During an upstroke of the pumping unit, the load on the polish rod side includes the belt, polish rod, rod string, sucker rod, the fluid being lifted and the dynamic load of stroke reversal, which may reach a maximum of 29,700 pounds in the example previously given. This load reduces to 18,300 in the downstroke as the sucker rod drops back down through the fluid. The enormous stress of the maximum load and the resulting requirement of heavy duty components in a safety mechanism, coupled with the wide fluctuations in loads between upstroke and downstroke, makes it virtually impossible to design a safety device with proper sensitivity which does not lock up prematurely due to load fluctuations alone when a condition of failure does not in fact exist. By sensing off the belt below the weight box, the safety mechanism sees only the differential in load between the polish rod side and the weight box, which in our prior example called for a weight box loading of 17,000 pounds, yields a maximum load seen by the safety mechanism of 12,700 pounds. Thus, a safety mechanism is provided with the necessary positive response to arrest and latch the counterweight against free fall without sacrificing critical sensitivity.

The invention may be embodied in other specific forms without departing from the spirit and other essential characteristics thereof. The present embodiment is therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed and desired to be secured by Letters Patent is:

1. A long stroke, well pumping unit for a well pump including a conventional polish rod, rod string and sucker rod comprising: a base platform and a tower mounted on the base platform; rotatable drum means on the base platform and power means for rotating the drum means; a flexible lift belt attached at one end to the drum means and at its other end to the upper end of the polish rod of a well pump; a freely rotatable spool atop the tower over which the lift belt is trained; a counterweight carried by the lift belt; means for reversing the power means thereby to provide reciprocating movement to the lift belt and thus the polish rod, and positive engagement safety means for arresting and locking the counterweight against free fall in the event of failure by fracture of the lift belt, polish rod, rod string or sucker rod comprising: a cross bar securely fastened to the upper end of that portion of the lift belt beneath the counterweight; guide means dependent from the counterweight and arranged to receive said cross bar and permit only limited movement thereof longitudinally in the plane of the lift belt; means mounted within said guide means for exerting a predetermined counter force on said cross bar in opposition to tension on said lower portion of the lift belt; a pair of racks mounted within the tower one on either side in the plane of the lift belt; latch means mounted to said guide means adjacent to each of said racks in opposing relationship for movement into and out of engagement therewith; means arranged in said guide means and responsive to movement of the cross bar longitudinally in the plane of the lift belt to move said latch means out of engagement with said racks when tension on the lift belt overcomes the predetermined counter force and for moving said latch means into engagement with said racks when tension on said lower porton of the lift belt is reduced below the level of the predetermined counter force, the predetermined counter force being selected so as to permit disengagement of the latch means from the racks under belt tensions corresponding to the normal operating loads of the pumping unit; whereupon failure by fracture of one of the well components or that portion of the lift belt between the polish rod and the spool, reduces belt tension below the level of the counter force in that portion of the lift belt beneath the counterweight thereby to allow said counter force exerting means to displace the cross bar longitudinally in the plane of the lift belt and cause said latch engagement means to move said latch means into engagement with said racks, thus to arrest and lock the counterweight against free fall.

2. In a long stroke, well pumping unit for a well pump having a conventional polish rod, rod string and sucker rod, and including a base platform, a tower on the base platform, rotatable drum means on the base platform, power means for rotating the drum means, a flexible lift belt attached at one end to the drum means and at its other end to the upper end of the polish rod of a well pump, a freely rotatable spool atop the tower over which the lift belt is trained, a counterweight carried by the lift belt, means for reversing the power means thereby to provide reciprocating movement to the lift belt and thus the polish rod, rod string and sucker rod of the pump; positive engagement safety means for arresting and locking the counterweight against free fall in the event of failure by fracture of the lift belt, polish rod, rod string or sucker rod, comprising: a cross bar securely fastened to the upper end of that portion of the lift belt beneath the counterweight; guide means dependent from the counterweight and arranged to receive said cross bar and permit only limited movement thereof longitudinally in the plane of the lift belt; means mounted within said guide means for exerting a predetermined counter force on said cross bar in opposition to tension on said lower portion of the lift belt; a pair of racks mounted within the tower one on either side in the plane of the lift belt; latch means mounted to said guide means adjacent to each of said racks in opposing relationship for movement into and out of engagement therewith; means arranged in said guide means and responsive to movement of the cross bar longitudinally in the plane of the lift belt to move said latch means out of engagement with said racks when tension on the lift belt overcomes the predetermined counter force and for moving said latch means into engagement with said racks when tension on said lower portion of the lift belt is reduced below the level of the predetermined counter force, the predetermined counter force being selected so as to permit disengagement of the latch means from the racks under belt tensions corresponding to the normal operating loads of the pumping unit; whereupon failure by fracture of one of the well components or that portion of the lift belt between the polish rod and the spool, reduces belt tension below the level of the counter force in that portion of the lift belt beneath the counterweight thereby to allow said counter force exerting means to displace the cross bar longitudinally in the plane of the lift belt and cause said latch engagement means to move said latch means into engagement with said racks, thus to arrest and lock the counterweight against free fall.

3. The safety means as claimed in claims 1 or 2, wherein the latch means comprise a pair of pawls pivotally mounted in the guide means, one arranged at either end of the cross bar in opposing relationship with a corresponding one of the racks; and wherein the latch engagement means comprise camming means mounted on the cross bar and cooperatively arranged adjacent to said pawls to engage and pivot said pawls out of engagement with the racks when the lift belt is tensioned under normal operating loads, and means for biasing said pawls normally into engagement with the racks.

4. The safety means as claimed in claims 1 or 2, wherein the guide means comprise a pair of parallel members spaced apart to receive the cross bar and arranged to permit movement of the cross bar longitudinally in the plane of the lift belt, and stops secured to and arranged between said guide members to restrict the longitudinal movement of the cross bar to defined limits calculated to allow sufficient movement of the cross bar to cause the latch engagement means to move the latch means out of engagement with the racks when the lift belt is tensioned under normal operating loads and to cause the latch engagement means to move the latch means into engagement with the racks when the belt lower tension is reduced below the level of the predetermined counter force; and wherein the counter force means comprise spring means arranged to bias the cross bar with a predetermined counter force resisting tension on the lower belt beneath the counterweight, which predetermined counter force is calculated to allow tensions in the lower belt under normal operating loads to overcome the counter force and displace the cross bar longitudinally in the plane of the belt against the stops between said parallel members thereby to cause the latch engagement means to disengage the latch means from the racks, and to return the cross bar when the lower belt tension is reduced to a level below the counter force thereby to cause the latch engagement means to engage the latch means with the racks, thus to arrest and lock the counterweight against free fall.

5. The safety means as claimed in claims 1 or 2, wherein the guide means comprise a pair of parallel members spaced apart to receive the cross bar and arranged to permit movement of the cross bar longitudinally in the plane of the lift belt, and stops secured to and arranged between said guide members to restrict the longitudinal movement of the cross bar to defined limits; wherein the latch means comprise a pair of pawls pivotally mounted between said parallel members, one arranged at either end of the cross member in opposing relationship with a corresponding one of the racks; wherein the latch engagement means comprise camming means mounted at either end of the cross bar and cooperatively arranged adjacent to said pawls whereby displacement of the cross bar under normal operating loads to a position against the stops causes said camming means to engage and pivot said pawls out of engagement with the racks and return of the cross bar to an uppermost position within the defined limits causes said camming means to recede and allow said pawls to pivot into engagement with the racks, and spring means arranged to bias said pawls normally into engagement with the racks; and wherein the counter force means comprise spring means arranged to bias the cross bar with a predetermined counter force resisting tension in the lower belt beneath the counterweight, which predetermined counter force is calculated to allow tension in the lower belt under normal operating loads to overcome the counter force and displace the cross bar longitudinally in the plane of the belt against the stops between said parallel members thereby to cause said camming means to engage and pivot said pawls out of engagement with the racks, and to return the cross bar when the lower belt tension is reduced to a level below the counter force thereby to cause said camming means to recede and allow said pawl biasing spring means to pivot said pawls back into engagement with the racks, thus to arrest and lock the counterweight against free fall.

6. The safety means as claimed in claim 5, wherein guide means are provided for the counterweight to facilitate alignment of the pawls and racks throughout the reciprocating movement of the counterweight within the tower during a complete cycle of the pumping unit, said guide means comprising one or more guide rails mounted in the tower and spanning the length of travel of the counterweight within the tower, and a plurality of freely rotatable rollers mounted on said counterweight and arranged to ride said rails and restrict lateral movement of the counterweight in any direction within the tower.

7. The safety means as claimed in claim 6, wherein the counterweight guide means comprise: a pair of parallel I-beams mounted on the base platform and stabilized to form the tower; a pair of freely rotatable wheels mounted at opposite corners on the sides of the counterweight facing the corresponding interior web of said I-beams, said wheels on one side being offset diagonally with respect to the wheels on the other side of the counterweight, and said wheels being arranged to ride on the interior web of the corresponding said I-beams; freely rotatable rollers mounted at each corner on the front of the counterweight and arranged to ride on the corresponding flange of said I-beams; and freely rotatable rollers mounted at each corner on the back of the counterweight and arranged ride on the corresponding flange of said I-beams.

* * * * *